US007703715B2

(12) United States Patent
Kinugasa et al.

(10) Patent No.: US 7,703,715 B2
(45) Date of Patent: Apr. 27, 2010

(54) TRANSFER TOOL

(75) Inventors: Shuji Kinugasa, Osaka (JP); Hideto Shima, Kyoto (JP); Takashi Mitsui, Osaka (JP)

(73) Assignee: Kokuyo Co., Ltd., Osaka-shi (JP)

( * ) Notice: Subject to any disclaimer, the term of this patent is extended or adjusted under 35 U.S.C. 154(b) by 0 days.

(21) Appl. No.: 12/149,819

(22) Filed: May 8, 2008

(65) Prior Publication Data

US 2009/0026307 A1 Jan. 29, 2009

(30) Foreign Application Priority Data

Jul. 27, 2007 (JP) ..... P2007-196634

(51) Int. Cl.
*B65D 85/02* (2006.01)

(52) U.S. Cl. ..... 242/588.6; 118/257

(58) Field of Classification Search ..... 242/588.6, 242/598.5–598.6, 588.3; 118/76, 257; 400/193, 400/695

See application file for complete search history.

(56) References Cited

U.S. PATENT DOCUMENTS

| | | | | |
|---|---|---|---|---|
| 5,785,437 | A * | 7/1998 | Koyama et al. | 400/193 |
| 5,792,263 | A * | 8/1998 | Koyama et al. | 118/257 |
| 6,422,284 | B1 | 7/2002 | Kelders et al. | |
| 6,510,884 | B1 * | 1/2003 | Chan | 156/527 |
| 6,550,518 | B1 * | 4/2003 | Lee | 156/577 |
| 6,554,045 | B1 * | 4/2003 | Lee | 156/577 |
| 6,599,363 | B2 * | 7/2003 | Narita | 118/76 |
| 7,416,152 | B2 * | 8/2008 | Wieser et al. | 242/598.5 |
| 2004/0033353 | A1 | 2/2004 | You | |
| 2006/0102769 | A1 * | 5/2006 | Wieser et al. | 242/560 |

FOREIGN PATENT DOCUMENTS

| | | |
|---|---|---|
| JP | 9-156823 | 6/1997 |
| JP | 2006-248182 | 9/2006 |
| JP | 2006-248182 A | 9/2006 |
| WO | WO 99/23022 | 5/1999 |

OTHER PUBLICATIONS

European Search Report dated Dec. 22, 2008.

* cited by examiner

*Primary Examiner*—Sang Kim
(74) *Attorney, Agent, or Firm*—McGinn IP Law Group, PLLC

(57) ABSTRACT

A transfer tool of the present invention comprises a pair of cases, and a hinge which connects the cases such that they can relatively move between a use position and an open position, wherein an outer edge of one of the first and second cases is provided outward of the hinge, a portion of the one case located outward of the hinge and an outer edge of a portion in the vicinity of the portion of the one case located outward of the hinge as a hinge corresponding portion are continuous with an outer edge of another portion of the one case, and a hinge corresponding portion of the other case is provided with an retraction space which can receive the hinge corresponding portion of the one case.

20 Claims, 10 Drawing Sheets

TRANSFER TOOL

BACKGROUND OF THE INVENTION

1. Field of the Invention

The present invention relates to a transfer tool having a pair of cases, and a hinge which connects the cases such that they can relatively move between a use position and an open position.

2. Background of the Related Art

Conventionally, there are conceived various transfer tools. In a transfer tool, a transfer tape supplied from a supply reel rotatable around a spindle is wound around a winding reel through a transfer head. In order to be replaceable at least the transfer tape and the supply reel around which the transfer tape is wound, the transfer tool includes a first case, a second case which pairs off with the first case, and a hinge which connects the first case and the second case such that they can relatively move between a use position and an open position. In a state where the first and second cases are disposed in the use position, the transfer tape and the supply reel are held in the first and second cases. See Japanese Patent Application Laid-open No. 2006-248182 for example.

According to the structure described in the Japanese Patent Application Laid-open No. 2006-248182, the hinge projects outward from the first and second cases. If such a structure is employed, the movable range of the first and second cases can be set to 180° or greater. However, if the first and second cases are disposed in the use position, since the hinge projects outward with respect to other portions, its outward appearance is marred, and when the transfer tool is grasped, a hand and the hinge interfere with each other, and there is a problem that it is not easy for a user to hold the transfer tool.

To solve such a problem, it seems to be an appropriate structure that the hinge is provided inside of the outer edges of the first and second cases. However, when this structure is employed, if the first and second cases are relatively moved toward the open position, the first and second cases interfere with each other before the phase is varied through 180° from the use position and they can not move further. That is, according to this structure, the movable range of the first and second cases can not be set to 180° or greater, therefore, there is another problem that when the supply reel is replaced by new one or when a refill having the supply reel is replaced by new one, a sufficient opening can not be secured, such a replacing operation can not easily be carried out.

SUMMARY OF THE INVENTION

The present invention has been accomplished to solve such problems, and the present invention satisfies both the outward appearance and the operability at a maximum.

That is, the present invention provides a transfer tool comprising a pair of cases, and a hinge which connects the cases such that they can relatively move between a use position and an open position, wherein, wherein an outer edge of one of the first and second cases is provided outward of the hinge, a portion of the one case located outward of the hinge and an outer edge of a portion in the vicinity of the portion of the one case located outward of the hinge as a hinge corresponding portion are continuous with an outer edge of another portion of the one case, and a hinge corresponding portion of the other case is provided with an retraction space which can receive the hinge corresponding portion of the one case.

According to this structure, since the outer edge of the one case is provided outward from the hinge, the hinge does not project outward alone in the use position, and the outward appearance is not marred. When a user grasps the transfer tool, the transfer tool and his or her hand does not interfere with each other, and it is not difficult for the user to hold the transfer tool. The hinge corresponding portion of the other case is provided with the retraction space which can receive the hinge corresponding portion of the one case. Thus, as both the cases relatively move toward the open position, the hinge corresponding portion of the one case is disposed in the retraction space, and the movable range of both the cases can be set to 180° or greater.

As one example of a concrete structure for realizing such a hinge of the transfer tool with a simple structure, there is a structure that the hinge includes a shaft member projecting from the one case, and a bearing portion which is provided on the other case and which pivotally supports the shaft member.

One example of a structure for enhancing the flexibility of a shape setting of an intermediate portion of the transfer tool in its longitudinal direction is that the hinge is provided on a rear end of the transfer tool. A shape of the rear end of the transfer tool as viewed from side is an arc which is coaxial with a supply reel or a winding reel accommodated in the first and second cases in many cases, and when the hinge is provided on the rear end, even if a narrow portion is provided in the longitudinal direction of the first and second cases, the one case and the other case do not interfere with each other when it is opened or closed.

According to the structure of the transfer tool of the present invention, since the outer edge of one of the cases is provided outward from the hinge, the hinge does not project outward alone in the use position, and the outward appearance is not marred. When a user grasps the transfer tool, the transfer tool and his or her hand does not interfere with each other, and it is not difficult for the user to hold the transfer tool. The hinge corresponding portion of the other case is provided with the retraction space which can receive the hinge corresponding portion of the one case. Thus, as both the cases relatively move toward the open position, the hinge corresponding portion of the one case is disposed in the retraction space, and the movable range of both the cases can be set to 180° or greater. Therefore, the present invention satisfies both the outward appearance and the operability at a maximum.

DETAILED DESCRIPTION OF THE PREFERRED EMBODIMENTS

An embodiment of the present invention will be explained with reference to the drawings.

Figure 1:
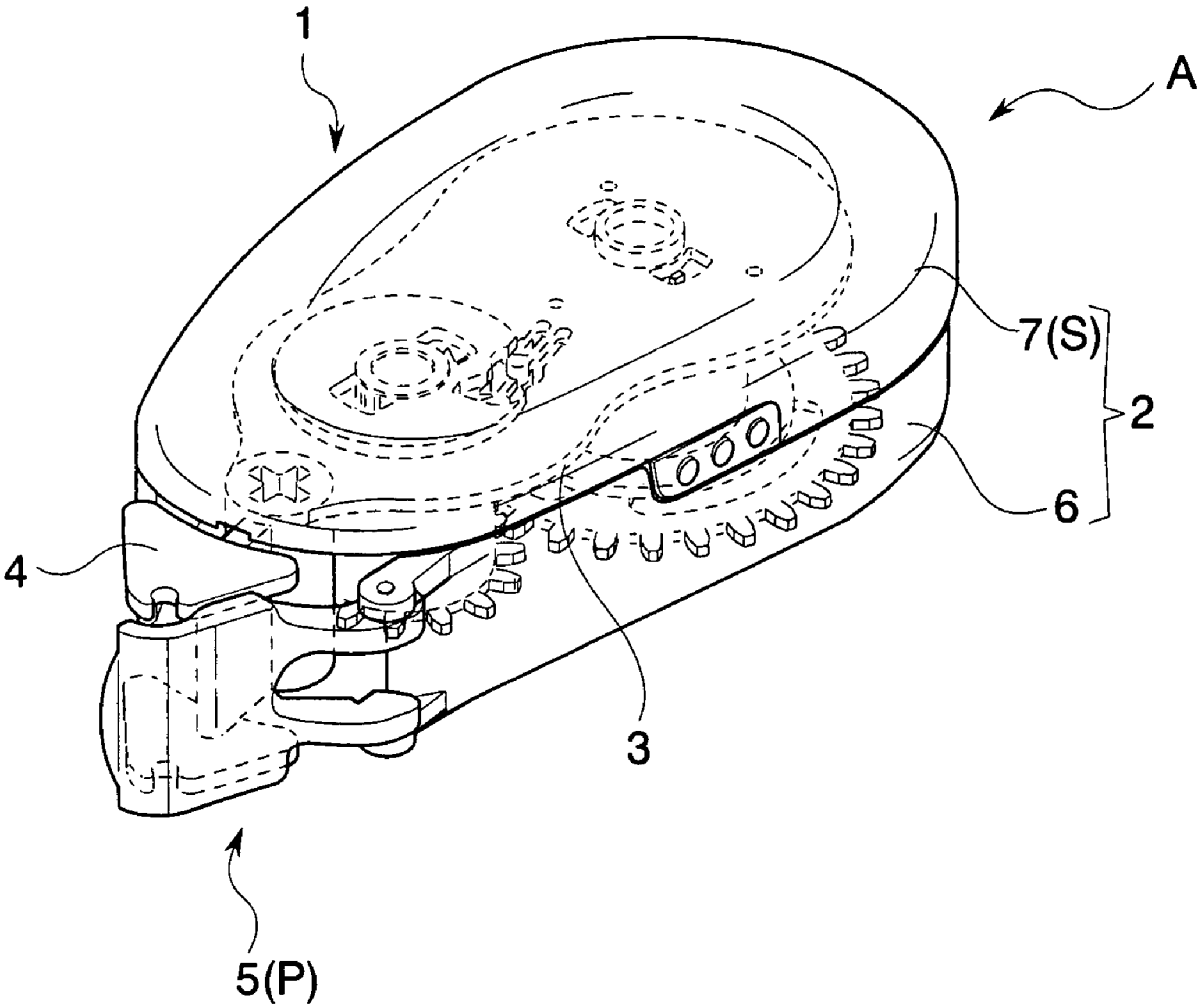
FIG. 1 is a perspective view of a state where a head cap of a transfer tool according to an embodiment of the present invention is disposed in a close position.
Figure 2:
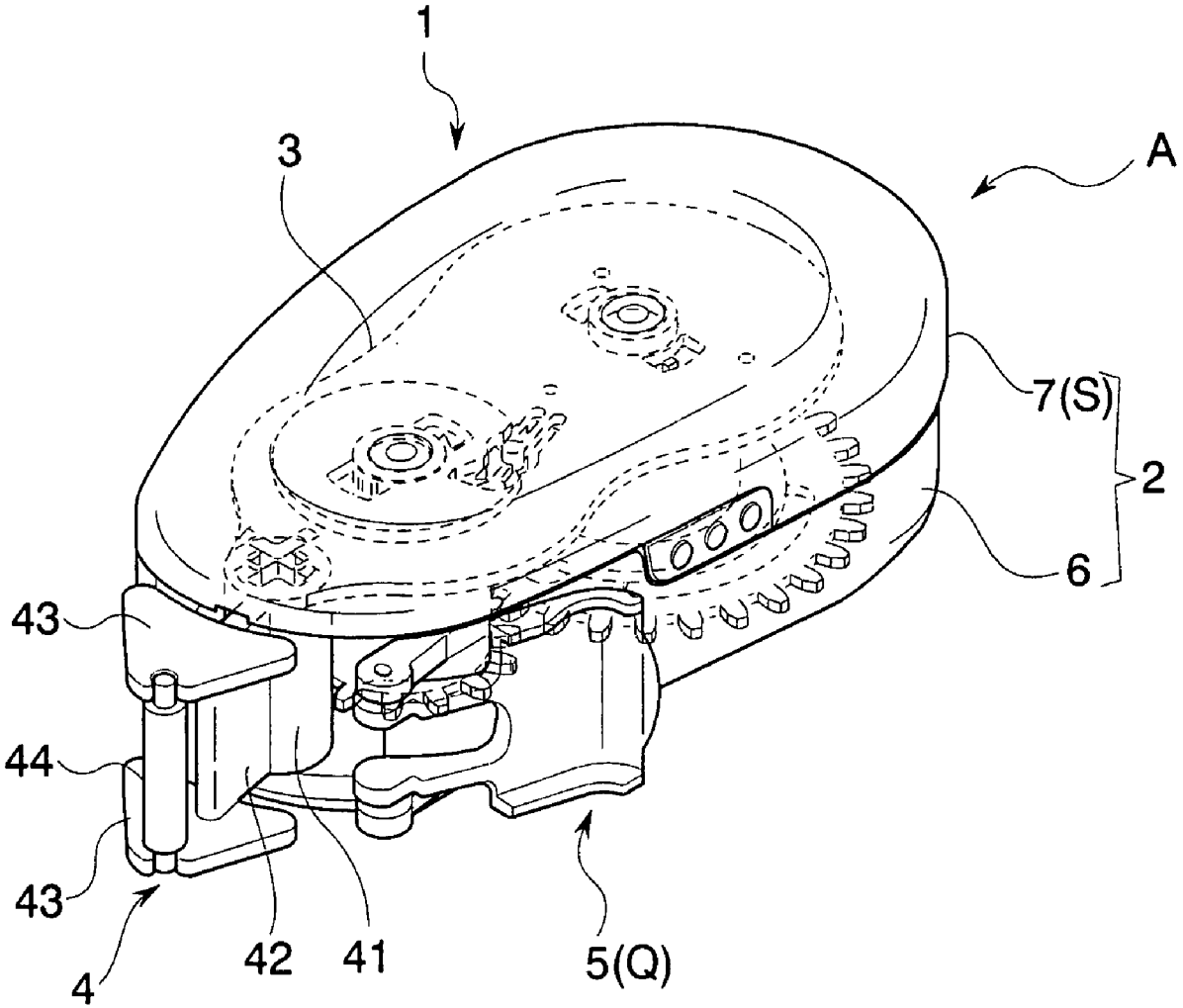
FIG. 2 is a perspective view of a state where the head cap of the transfer tool of the embodiment is disposed in an open position.
Figure 3:
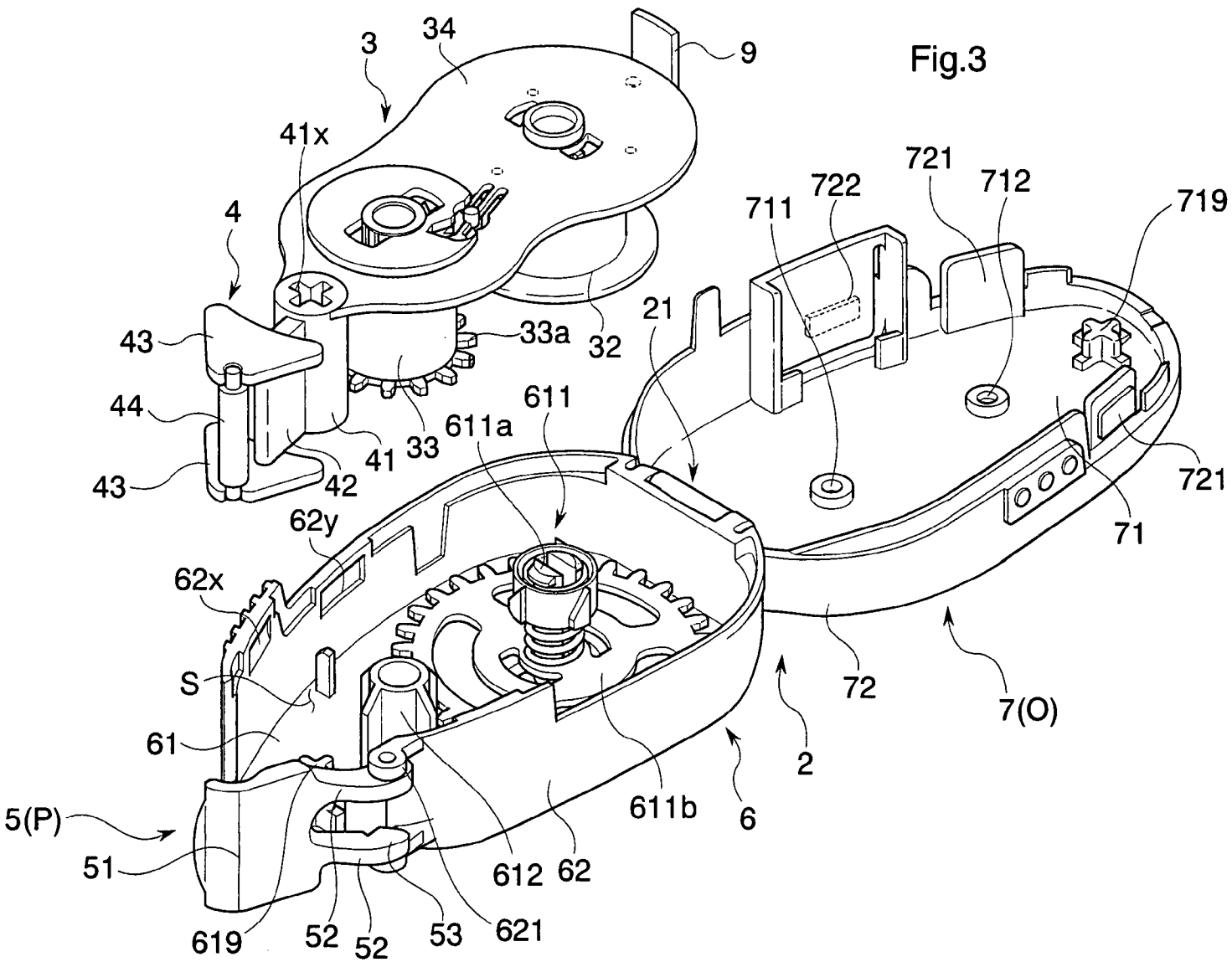
FIG. 3 is an exploded perspective view of the transfer tool of the embodiment.
Figure 4A:
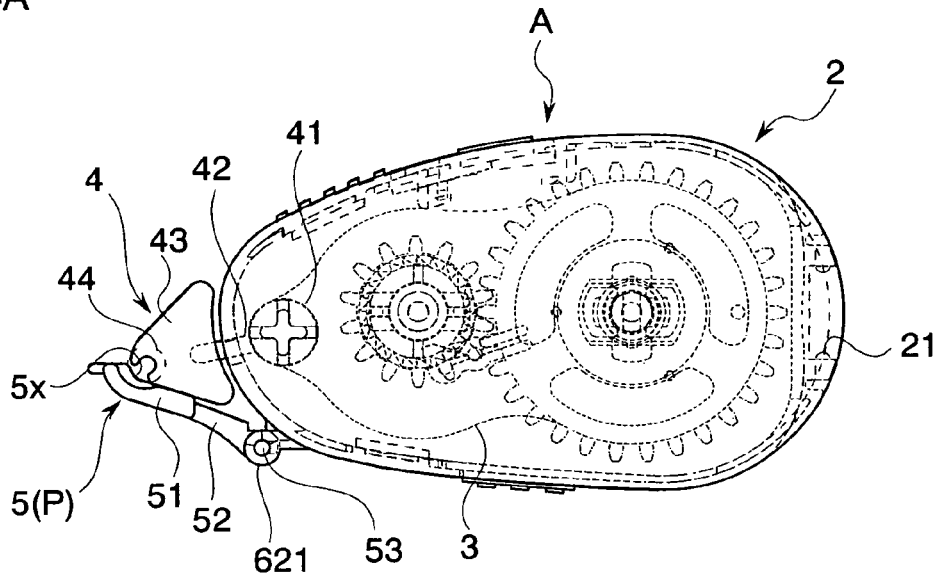
FIGS. 4A, 4B, and 4C are a side view, a bottom view and a central vertical sectional view of the transfer tool of the embodiment, respectively.
Figure 4B:
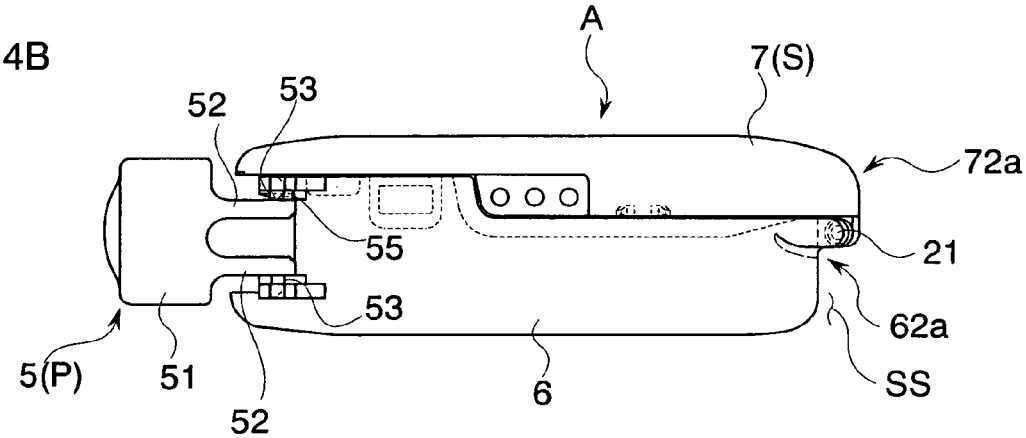
Figure 4C:
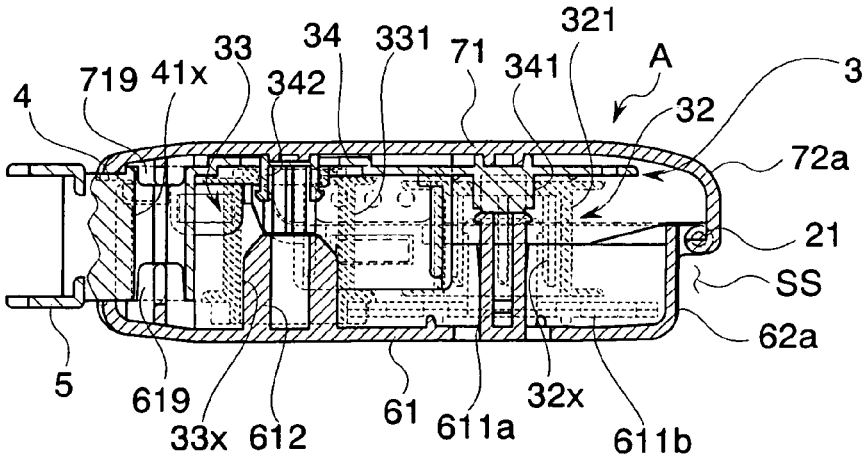

As shown in FIGS. 1 to 5, a transfer tool A according to the embodiment includes a transfer tool body 1 having a case portion 2 and a refill 3 which can hold the case portion 2, a transfer head 4 which is held by the transfer tool body 1, more specifically by the refill 3, and a head cap 5 which is pivotally attached to the transfer tool body 1, more specifically to the case portion 2. FIG. 1 is a perspective view of a state where the head cap 5 of the transfer tool A is disposed in a later-described close position P. FIG. 2 is a perspective view of a state where the head cap 5 of the transfer tool A is disposed in a later-described open position Q. FIG. 3 is an exploded perspective view of the transfer tool A. FIG. 4A is a side view of the transfer tool A, FIG. 4B is a bottom view of the transfer tool A, and FIG. 4C is a vertical sectional view taken along the center of the transfer tool A.

Parts constituting the transfer tool A will be explained below. In the following explanation, unless otherwise specified, "front" means a side where the transfer head 4 exists and "back" means a side opposite from the transfer head 4. An example of a transferring object is paste, or a correcting ink coating film or the like for correcting a character or a figure written or printed on a paper sheet or a film which is an object to be transferred.

As described above, the transfer tool body 1 includes the case portion 2 and the refill 3 which is detachably held in the case portion 2. The case portion 2 includes a first case 6, a second case 7 which pairs off with the first case 6, and a hinge 21 which connects the first and second cases 6 and 7 such that they can relatively move between a use position S and an open position O.

Figure 5:
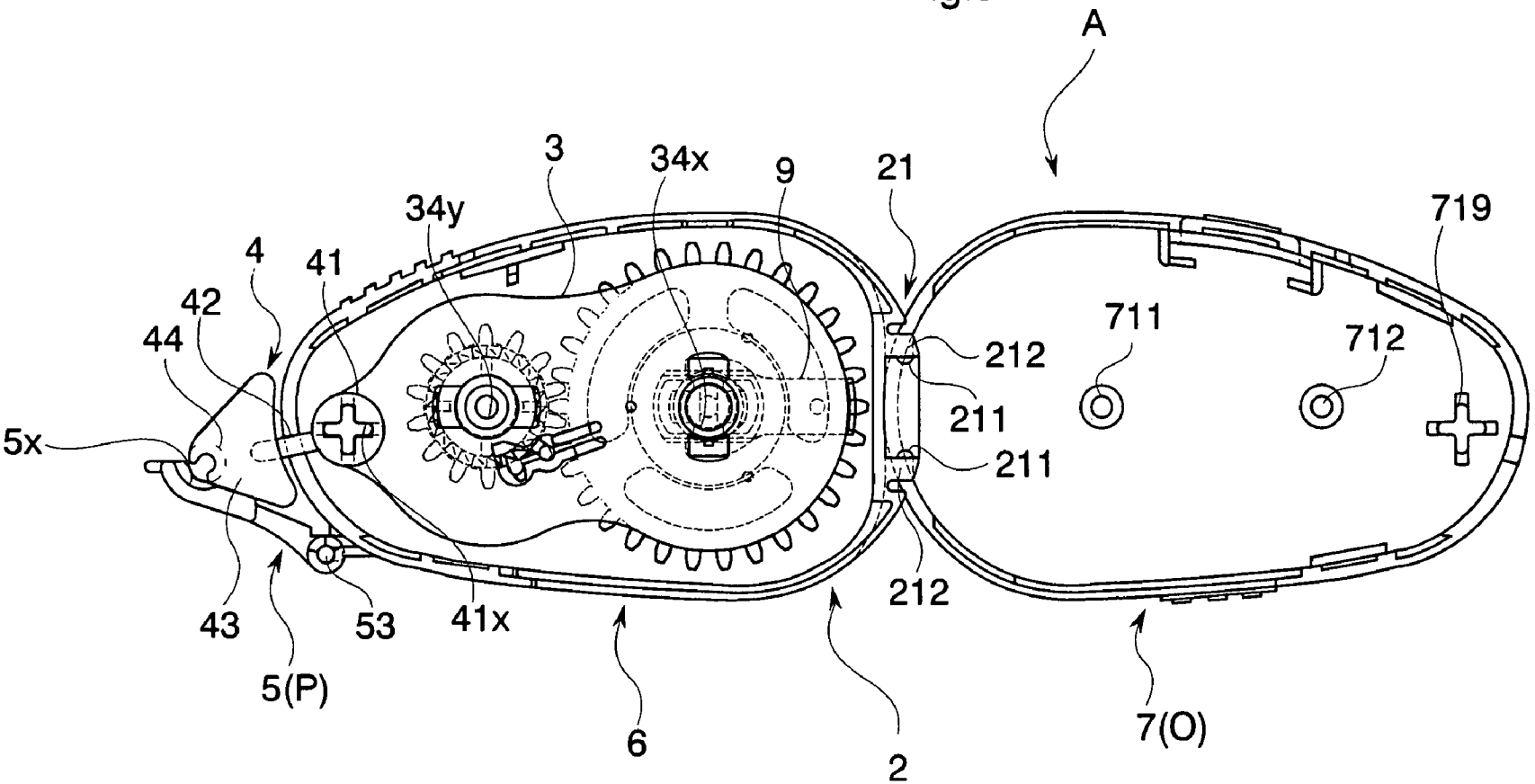
FIG. 5 is a side view of a state where the first case and the second case of the transfer tool of the embodiment are relatively moved to the open position.
Figure 6A:
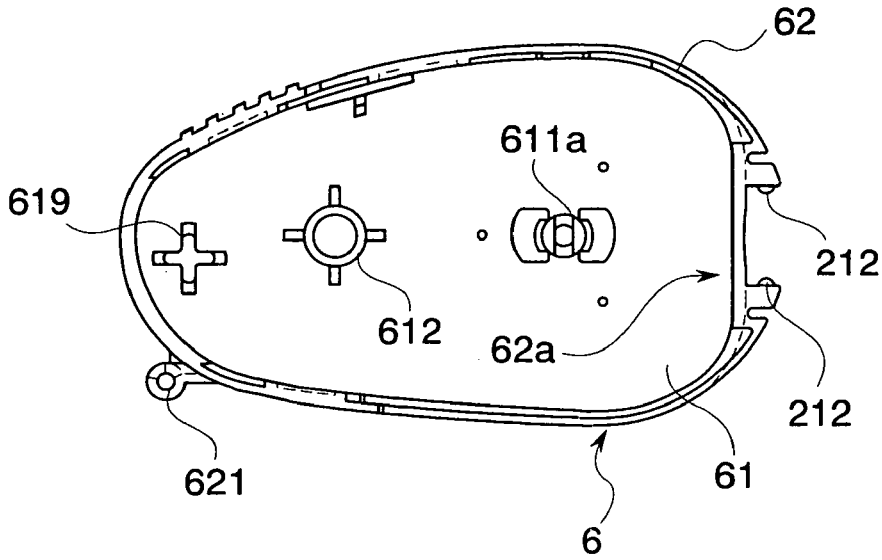
FIGS. 6A, 6B, and 6C are a side view, a bottom view and a central vertical sectional view of the first case of the transfer tool of the embodiment, respectively.
Figure 6B:
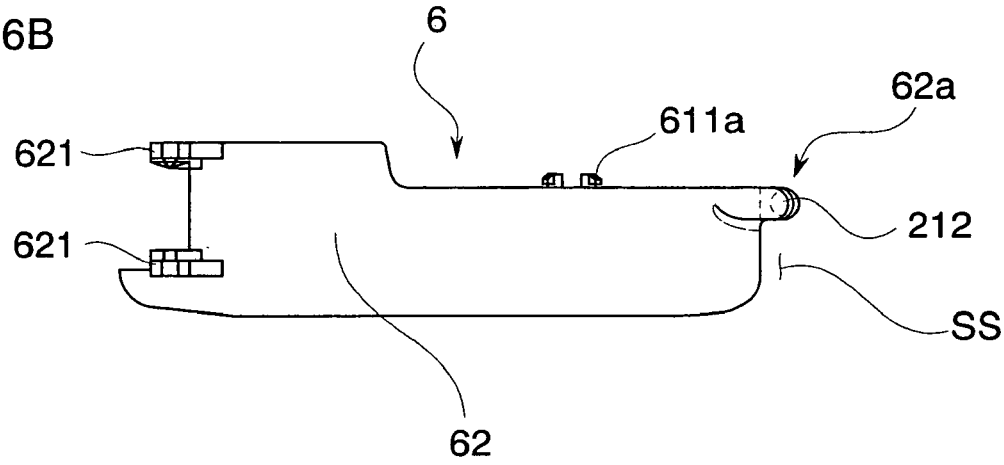
Figure 6C:
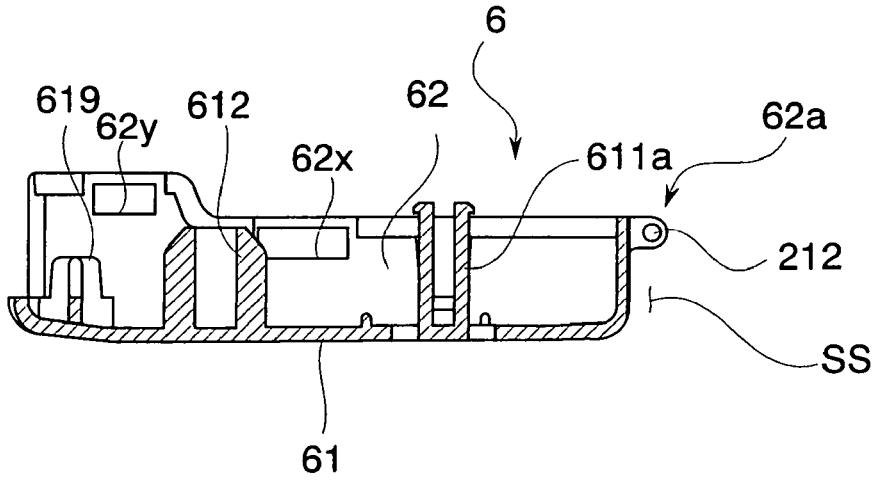

Constituent parts of the case portion 2 will be explained in more detail. As shown in FIG. 6, the first case 6 includes a main wall 61 forming a main body of the first case 6, and an outer wall 62 which is integrally formed on the main wall 61 and which surrounds the main wall 61. In the first case 6, a refill accommodation space S in which the refill 3 can be accommodated is formed. The refill accommodation space S is defined by the main wall 61 and the outer wall 62. FIG. 5 is a side view of a state where the first and second cases 6 and 7 of the transfer tool A of the embodiment are relatively moved to the open position O. FIGS. 1, 2 and 4 show a state where the first and second cases 6 and 7 are relatively moved to the use position S. FIG. 6A is a side view of the first case 6, FIG. 6B is a bottom view of the first case 6 and FIG. 6C is a sectional view taken along the center of the first case 6.

The main wall 61 is provided therein with a supply reel mounting portion 611 for rotatably mounting a supply reel 32 of the refill 3, and a winding reel mounting portion 612 for rotatably supporting a winding reel 33 of the refill 3. The supply reel mounting portion 611 includes a supply reel support portion 611*a* which can rotate together with the supply reel 32 if the supply reel support portion 611*a* is inserted into a later-described meshing hole (not shown) of the supply reel 32, and a drive gear 611*b* which is coaxially mounted on the supply reel support portion 611*a* through a slide mechanism (not shown). The winding reel mounting portion 612 is integrally formed from the main wall 61 into a substantially cylindrical shape, and the winding reel mounting portion 612 can be inserted into a later-described winding reel mounting hole (not shown) formed in a tip end of the winding reel 33.

The outer wall 62 projects from a portion of the outer edge of the main wall 61 except the front end. The rear end of the outer wall 62 is formed as a hinge corresponding portion 62*a* to provide the hinge 21 on the rear end of the outer wall 62. An outer peripheral surface of the hinge corresponding portion 62*a* is continuous with an outer peripheral surface of other portion of the outer wall 62. The transfer head 4 passes through a head-exposing opening and is exposed outside. The head-exposing opening is a portion where the outer wall 62 is not provided.

Figure 7A:
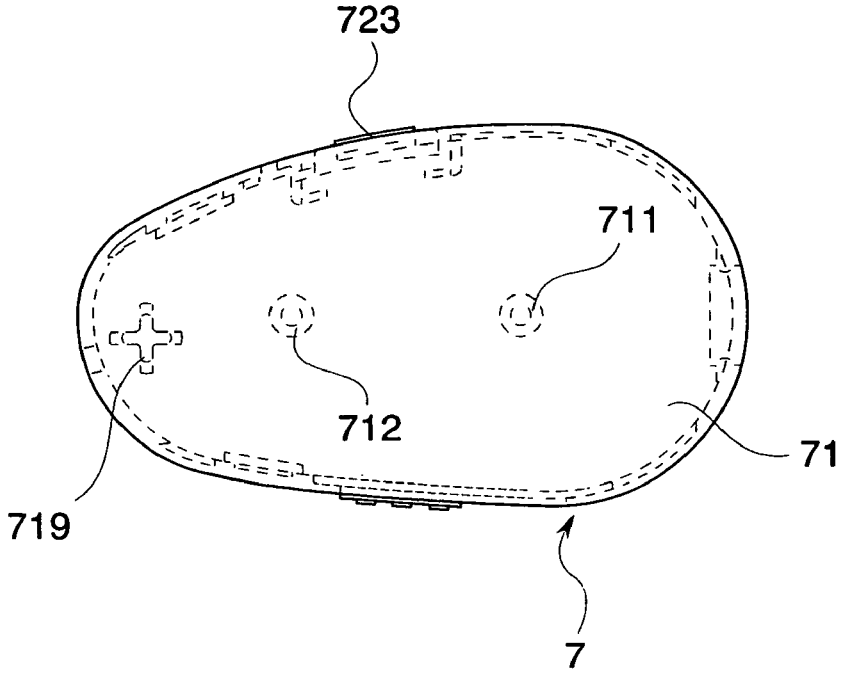
FIGS. 7A, 7B, and 7C are a side view, a bottom view and a central vertical sectional view of the second case the transfer tool of the embodiment, respectively.
Figure 7B:
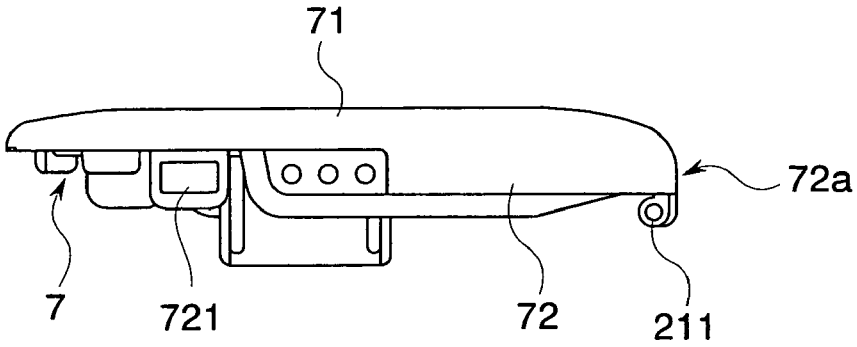
Figure 7C:
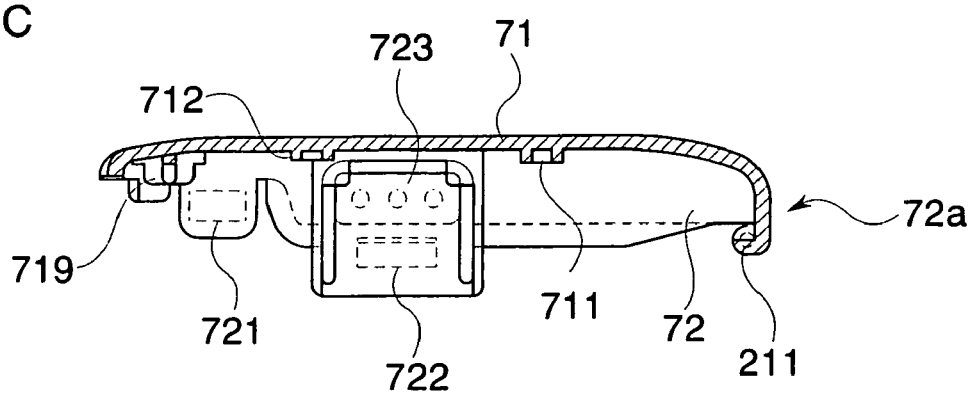

As shown in FIG. 7, the second case 7 includes a lid 71 which substantially closes the refill accommodation space S of the first case 6, and an outer wall 72 which projects from an outer edge of the lid 71 and its projecting end is overlapped on an outer wall 62 of the first case 6. FIG. 7A is a side view of the second case 7, FIG. 7B is a bottom view of the second case 7 and FIG. 7C is a vertical sectional view taken along the center of the second case 7.

The lid 71 is formed with insertion projections 711 and 712 which can be fitted into supported holes 34*x* and 34*y* formed in a support plate 34 at two locations corresponding to centers of the supply reel 32 and the winding reel 33.

To provide the hinge 21 on the rear end of the outer wall 72, the rear end of the outer wall 72 is formed as a hinge corresponding portion 72*a*. An outer peripheral surface of the hinge corresponding portion 72*a* is continuous with an outer peripheral surface of the other portion of the outer wall 72.

Front engaging part and rear engaging part are provided between the first case 6 and the second case 7 to realize a reliable engagement between the first and second cases 6 and 7. The front engaging part engages a front engaging recess 62*x* formed in a front portion of the outer wall 62 of the first case 6 and a front engaging pawl 721 provided on the outer wall 72 of the second case 7 at a location where a position thereof in the longitudinal direction matches with the front engaging recess 62*x* in the use position S with each other. The rear engaging part engages a rear engaging recess 62*y* provided at a central portion of the outer wall 62 of the first case 6 in the longitudinal direction and a rear engaging pawl 722 with each other. The rear engaging pawl 722 is provided on a portion of the outer wall 72 of the second case 7 which matches with the rear engaging recess 62*y* in the use position S in the longitudinal direction. The rear engaging pawl 722 can move between an engaging position where the rear engaging pawl 722 engages with the rear engaging recess 62*y* and a separating position where the rear engaging pawl 722 is separated from the rear engaging recess 62*y*. An operating portion 723 is provided near the rear engaging pawl 722. If the operating portion 723 receives an operating force, the rear engaging pawl 722 elastically deforms and moves from the engaging position to the separating position.

As described above, the hinge 21 connects the first and second cases 6 and 7 such that they can relatively move between the use position Sand the open position O. A detailed structure of the hinge 21 will be described later.

The transfer tool A of the embodiment further includes a transmission mechanism which is provided between the first case 6 and the refill 3 for transmitting rotation of the supply reel 32 to the winding reel 33.

The refill 3 is held between the first case 6 and the second case 7. The refill 3 includes the supply reel 32 which holds an unused transfer tape in a state, the unused transfer tape being wounded on the supply reel 32 in the state, the winding reel 33 around which a used transfer tape film is wound, and a support plate 34 which rotatably supports the supply reel 32 and the winding reel 33 and which integrally holds the transfer head 4.

The transfer head 4 can transfer a transferring object provided on a transfer tape to an object to be transferred. In this embodiment, the transfer head 4 is supported by the refill 3, and the refill 3 and the transfer head 4 are integrally handled.

As shown in FIG. 4, the supply reel 32 includes a supply reel body 321 forming a main body of the supply reel 32, and a meshing hole 32*x* which can accommodate the supply reel 32 when a transfer tape is pulled out from the supply reel support portion 611*a* such that rotation of the supply reel 32 can be transmitted and the meshing hole 32*x* meshes with the supply reel support portion 611*a*.

As shown in FIG. 4, the winding reel 33 includes a winding reel body 331 forming a main body of the winding reel 33, a winding reel mounting hole 33*x* which can accommodate the winding reel mounting portion 612 such that the winding reel mounting hole 33*x* can rotate with respect to the winding reel mounting portion 63, and a follower gear 33*a* which is formed on a peripheral edge of the winding reel mounting hole 33*x* and which can mesh with the drive gear 611*b*. That is, in this embodiment, the supply reel support portion 611*a* and the drive gear 611*b* which constitute the supply reel mounting portion 611, and the follower gear 33*a* constitutes the transmitting mechanism.

As shown in FIG. 4, a front end of the support plate 34 supports a base end 41 of the transfer head 4 such that the base end 41 can not rotate. The support plate 34 is provided at its surface opposed to the first case 6 with a supply reel holding portion 341 and a winding reel holding portion 342 which rotatably hold the supply reel 32 and the winding reel 33, respectively. Supported holes 34*x* and 34*y* are formed in the surface of the support plate 34 opposed to the second case 7 at locations corresponding to centers of the supply reel 32 and the winding reel 33, respectively.

In addition, a stopping member 9 can be inserted and pulled out between the supply reel 32 and the support plate 34 to prevent the supply reel 32 from rotating when the refill 3 is transported alone. As shown in FIG. 10, the stopping member 9 includes a stopping body 91 inserted between the supply reel 32 and the support plate 34, an abutting portion 92 which is provided on one end of the stopping body 91 and which abuts against the supply reel support portion 611*a* of the first case 6 when the stopping member 9 is disposed to a predetermined inserting position, a knob 93 which is provided on the other end of the stopping body 91 and which projects toward the second case 7 in a state where the refill 3 is mounted on the first case 6, and a projection 94 which is provided on one surface of the stopping body 91 and which can be engaged with an engaging recess 34*z* formed in the support plate 34 when the stopping member 9 is disposed in the predetermined inserting position.

Figure 9A:
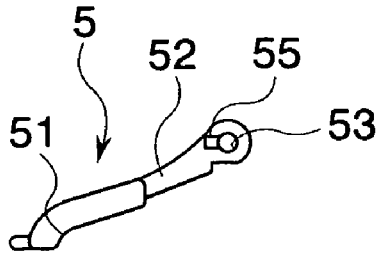
FIGS. 9A, 9B, 9C, and 9D are a right side view, a bottom view, a plan view and a left side view of the head cap of the embodiment, respectively.
Figure 9B:
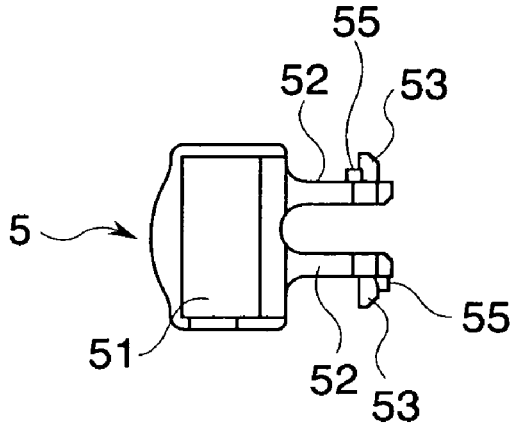
Figure 9C:
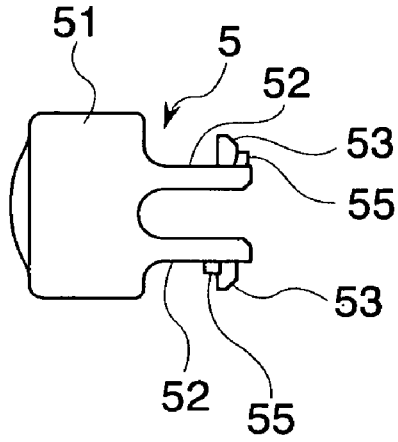
Figure 9D:
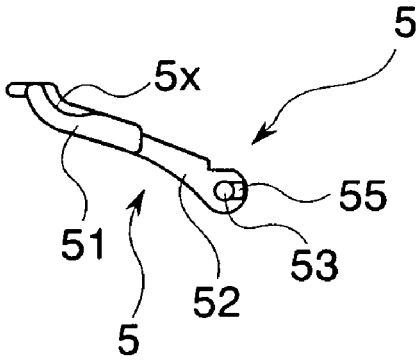
Figure 10A:
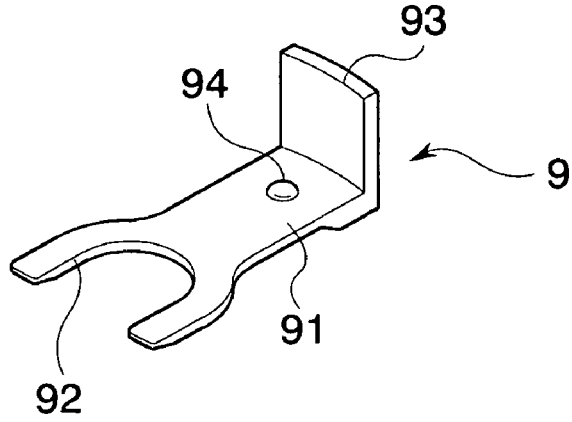
FIGS. 10A, 10B, 10C, and 10D are a perspective view, a front view, a side view and a plan view of a stopping member of the embodiment, respectively.
Figure 10B:
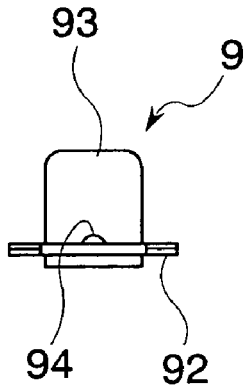
Figure 10C:
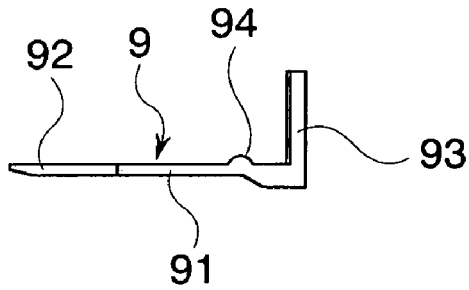
Figure 10D:
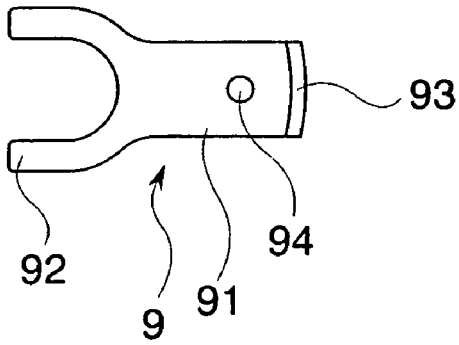

FIG. 10A is a perspective view of the stopping member 9, FIG. 9B is a front view of the stopping member 9, FIG. 10C is a side view of the stopping member 9 and FIG. 10D is a plan view of the stopping member 9.

As shown in FIGS. 3 and 5, the transfer head 4 includes a base end 41 integrally formed on the support plate 34 of the refill 3, an extension plate 42 extending forward from the base end 41, restriction plates 43 and 43 formed on both sides of the extension plate 42 as outer plates, and a transfer roller 44 which is rotatably supported by tip ends of the restriction plates 43 and 43 as folding back guide portion. The base end 41 is set such that the base end 41 can slightly deform when the transfer head 4 which is being used is pressed in this embodiment. The restriction plates 43 and 43 are provided for stably moving the transfer tape while suppressing deviation of the transfer tape sideway and for transferring the transferring object to the object which is to be transferred. That is, a transfer tape passage is formed between the restriction plates 43 and 43. A surface of the transfer roller 44 is made of material which can elastically deform so as to press the transfer tape against the object to be transferred. An engaging portion which can prohibit the relative turning motion between the base end 41 and the case portion 2 (i.e., first case 6 and second case 7) is provided between the base end 41 of the transfer head 4, the first case 6 and the second case 7. This engaging portion is provided on the base end 41 of the transfer head 4, and engages a cross groove 41*x* opening in a width direction of the transfer tool A and cross ribs 619 and 719 provided on the first case 6 and the second case 7 with each other.

The head cap 5 is pivotally supported by the first case 6 through the pivot shaft 53. The head cap 5 can turn between the close position P where the head cap 5 can cover a tip end of the transfer head 4 and an open position Q where the tip end of the transfer head 4, i.e., at least the restriction plates 43 and 43 and the transfer roller 44 are exposed.

More specifically, as shown in FIG. 9, the head cap 5 includes a cap body 51 which is opposed to a lower surface of the restriction plate 43 of the transfer head 4 in the close position P (surface to be opposed to an object to be transferred) and which cover a tip lower end of the transfer head 4, connecting arms 52 extending from both end edges of the cap body 51, and a pivot shaft portion 53 which is provided on an end of the connecting arm 52 and which is pivotally supported on a cap receiver 621 provided on the outer wall 62 of the first case 6. The head cap 5 is located outside of an inserting and pulling out locus of the transfer head 4 when the head cap 5 is disposed in the close position P. In this embodiment, the inserting and pulling out locus of the transfer head 4 is a locus of the transfer head 4 from a position where the transfer head 4 which is integrally constituted with the refill 3 is mounted on the first case 6 to a position where it is moved by the longitudinal size of the supply reel mounting portion 611, i.e., a projecting width from the main wall 61 in the pulling out direction. That is, the head cap 5 has a shape which is not overlapped on the transfer head 4 as viewed from side in the pulling out direction when the head cap 5 is disposed in the close position P. In other words, the head cap 5 can form a head inserting and pulling out space so that the transfer head 4 can move in the inserting and pulling out direction of the transfer head 4 in the pulling out direction of the transfer head 4. The head cap 5 includes a head accommodating recess 5*x* in which the transfer roller 44 of the transfer head 4 can be accommodated when the head cap 5 is disposed in the close position P. FIG. 9A is a right side view of the head cap 5, FIG. 9B is a bottom view of the head cap 5, FIG. 9C is a plan view of the head cap 5 and FIG. 9D is a left side view of the head cap 5.

Figure 8A:
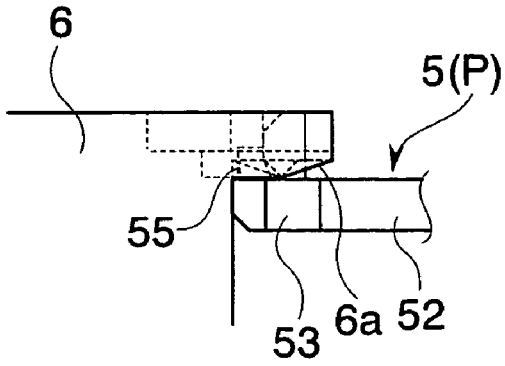
FIGS. 8A, 8B, and 8C are an explanatory diagram of function of a holding mechanism of the transfer tool of the embodiment, respectively.
Figure 8B:
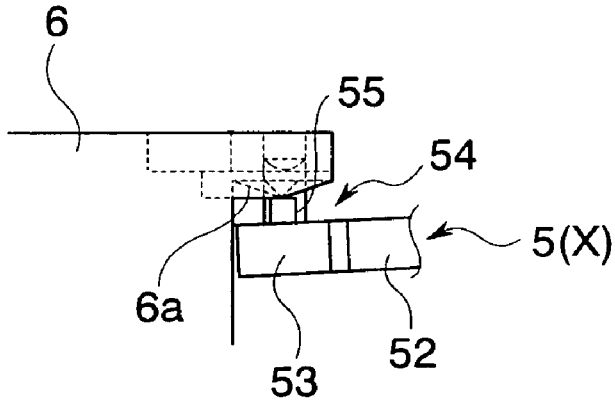
Figure 8C:
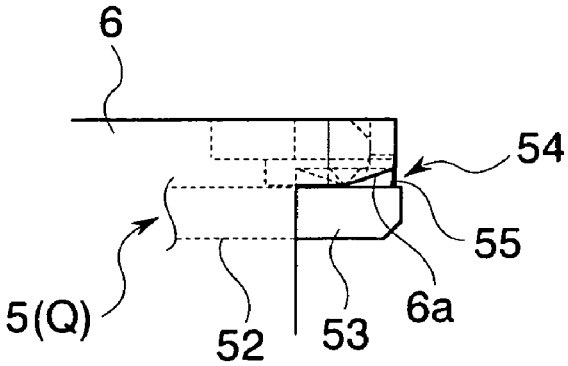

An urging mechanism 54 which selectively elastically urges the head cap 5 toward the close position P or the open position Q is provided in the vicinity of the pivot shaft portion 53 of the head cap 5. More specifically, as shown in FIG. 8, a projection 55 projects from the pivot shaft portion 53, and a cam face portion 6*a* which can slide on the projection 55 is provided adjacent to the bearing of the first case 6. The cam face portion 6*a* and the projection 55 slide on each other, the projection 55 and other connecting arm 52 provided on the pivot shaft portion 53 are elastically deformed, and they move toward the other connecting arm 52. The cam face portion 6*a* has only one dead point X at which a distance between the dead point X and the axis of the pivot shaft portion 53 becomes minimum and the moving amount of the connecting arm 52 becomes maximum when the head cap 5 is located at an intermediate location between the close position P and the open position Q. The cam face portion 6*a* urges the head cap 5 toward the close position P if the head cap 5 is closer to the close position P, and toward the open position Q if the head cap 5 is closer to the open position Q. FIG. 8A shows a state where the head cap 5 is disposed in the close position P, FIG. 8B shows a state where the head cap 5 is disposed at the dead point X, and FIG. 8C shows a state where the head cap 5 is disposed in the open position Q.

In this embodiment, the hinge 21 is provided inward of the outer edge of the second case 7. More specifically, the hinge 21 is formed by utilizing a shaft member 211 projecting from the second case 7, and bearings 212 and 212 which are provided in pairs for the first case 6 and which pivotally support the shaft member 211 from both sides. A retraction space SS is provided near the hinge 21 of the first case 6, preferably in front of the bearings 212 and 212. The retraction space SS can receive the second case 7 in the open position Q.

As described above, the transfer tool A of the present invention includes the first case 6, the second case 7 which pairs off with the first case 6, and the hinge 21 which connects the first and second cases 6 and 7 with each other such that they can relatively move between a use position S and an open position O, an outer edge of the second case 7 is provided outward of the hinge 21, an outer edge of the hinge corresponding portion 7*a* of the second case 7 is continuous of an outer edge of the other portion of the second case 7, and the hinge corresponding portion 6*a* of the first case 6 is provided with the retraction space SS which can receive the hinge corresponding portion 7*a* of the second case 7. Therefore, only the hinge 21 does not project outward in the use position S, the outward appearance is not marred. When a user grasps the transfer tool A, a case in which the user feels that the hinge 21 and his or her hand interfere with each other and it is difficult to hold the transfer tool A can be avoided. Since the hinge corresponding portion 6*a* of the first case 6 is provided with the retraction space SS which can receive the hinge corresponding portion 7*a* of the second case 7, the hinge corresponding portion 7*a* of the second case 7 is disposed in the retraction space SS as the first and second cases 6 and 7 relatively move toward the open position, and the movable ranges of the first and second cases 6 and 7 can be set to 180° or greater.

Since the hinge 21 includes the shaft member 211 projecting from the second case 7 and the bearing portion 212 which is provided on the first case 6 to pivotally support the shaft member 211, it is possible to realize the hinge 21 of the transfer tool A with a simple structure.

Since the hinge 21 is provided on the rear end of the arc case portion 2 which is coaxial with the supply reel 32, it is possible to prevent the first case and second case from interfering with each other when they are opened or closed.

The present invention is not limited to the above-described embodiment.

For example, the hinge need not be provided on the rear end, and can be provided at an intermediate portion in the longitudinal direction only if one of both upper end lower end edges is straight in the intermediate portion of the transfer tool in the longitudinal direction.

The first case and the second case may be integrated by injection molding, a thin portion may be formed at a boundary between the first case and the second case, and the thin portion may function as the hinge.

The present invention can variously be modified in a range not departing from its subject matter of the present invention.

What is claimed is:

1. A transfer tool, comprising:

a pair of cases;

a hinge which connects the cases such that the cases relatively move between a use position and an open position; and a supply reel mounting portion having an axis of rotation in a perpendicular direction with respect to a direction of axis of rotation of said hinge, wherein an outer edge of one of the cases is provided outward of the hinge, a portion of the one case located outward of the hinge and an outer edge of a portion in a vicinity of the portion of the one case located outward of the hinge as a hinge corresponding portion are continuous with an outer edge of another portion of the one case, and a hinge corresponding portion of an other case is provided with a retraction space which receives the hinge corresponding portion of the one case, and wherein said retraction space is provided below the hinge as an indentation in an extension of a curvature of an upper surface of the one of the cases through said outer edge of the one of the cases such that the one of the cases rotates around the hinge more than 180° in the open position.

2. The transfer tool according to claim 1, wherein the hinge includes a shaft member projecting from the one case, and a bearing portion which is provided on the other case and which pivotally supports the shaft member.

3. The transfer tool according to claim 2, wherein the hinge is provided on a rear end of the transfer tool.

4. The transfer tool according to claim 1, wherein the hinge is provided on a rear end of the transfer tool.

5. The transfer tool according to claim 1, further comprising:

a winding reel mounting portion having an axis of rotation parallel to said axis of rotation of the supply reel mounting portion.

6. The transfer tool according to claim 5, wherein said supply reel mounting portion and said winding reel mounting portion are formed on a bottom surface of the other case, said bottom surface being parallel to said axis of rotation of said hinge.

7. The transfer tool according to claim 5, wherein the supply reel mounting portion rotatably engages with a supply reel of a refill, and wherein the winding reel mounting portion rotatably supports a winding reel of the refill.

8. The transfer tool according to claim 7, wherein a lid of the one case comprises a couple of insertion projections, said insertion projections being fitted into supported holes and formed in a support plate at two locations corresponding to centers of the supply reel and the winding reel.

9. The transfer tool according to claim 7, wherein the supply reel mounting portion comprises:

a supply reel support portion which rotates together with the supply reel when the supply reel support portion is inserted into a meshing hole of the supply reel; and a drive gear which is coaxially mounted on the supply reel support portion.

10. The transfer tool according to claim 7, wherein the winding reel mounting portion is inserted into a winding reel mounting hole formed in a tip end of the winding reel.

11. The transfer tool according to claim 1, wherein, in said open position, an entire upper surface of the case and an entire upper surface of the other case are exposed, and wherein, in said use position, said upper surface of the case extends outside said upper surface of the other case in a rear end of the transfer tool, and coincides with said upper surface of the other case in a front end of the transfer tool.

12. A transfer tool, comprising:

a first case;

a second case; and a hinge which connects the first case and second case such that the first case and the second case relatively move between a use position and an open position, wherein an outer edge of the second case is provided outward of the hinge, a portion of the second case located outward of the hinge is continuous with an outer edge of another portion of the second case, and a hinge corresponding portion of the first case is provided with a retraction space which receives a hinge corresponding portion of the second case, wherein, on a bottom surface of the first case, a supply reel mounting portion and a winding reel mounting portion are formed, said winding reel mounting portion having an axis of rotation in a perpendicular direction with respect to a direction of an axis of rotation of said hinge, and in a parallel direction with respect to an axis of rotation of said supply reel mounting portion, and wherein said retraction space is provided below the hinge as an indentation in an extension of a curvature of an upper surface of the second case through said outer edge of the second case such that the second case rotates around the hinge more than 180° in the open position.

13. The transfer tool according to claim 12, wherein said bottom surface is parallel to said axis of rotation of said hinge.

14. The transfer tool according to claim 12, wherein said supply reel mounting portion and said winding reel mounting portion are formed on a bottom surface of the first case, said bottom surface being parallel to said axis of rotation of said hinge.

15. The transfer tool according to claim 12, wherein in said open position an entire upper surface of the first case and an entire upper surface of the second case are exposed, and wherein in said use position, said upper surface of the second case extends outside said upper surface of the first case in a rear end of the transfer tool, and coincides with said upper surface of the first case in a front end of the transfer tool.

16. The transfer tool according to claim 12, wherein the supply reel mounting portion rotatably engages with a supply reel of a refill, and wherein the winding reel mounting portion rotatably supports a winding reel of the refill.

17. The transfer tool according to claim 16, wherein a lid of the second case comprises a couple of insertion projections, said insertion projections being fitted into supported holes and formed in a support plate at two locations corresponding to centers of the supply reel and the winding reel.

18. The transfer tool according to claim 16, wherein the supply reel mounting portion comprises:

a supply reel support portion which rotates together with the supply reel when the supply reel support portion is inserted into a meshing hole of the supply reel; and a drive gear which is coaxially mounted on the supply reel support portion.

19. The transfer tool according to claim 16, wherein the winding reel mounting portion is inserted into a winding reel mounting hole formed in a tip end of the winding reel.

20. A transfer tool, comprising:

a first case;

a second case;

a hinge which connects the first case and the second case such that the first case and the second case relatively move between a use position and an open position;

a winding reel mounting portion having an axis of rotation in a perpendicular direction with respect to a direction of an axis of rotation of said hinge; and a supply reel mounting portion having an axis of rotation parallel to said axis of rotation of the winding reel mounting portion, wherein an outer edge of the second case is provided outward of the hinge, a portion of the second case located outward of the hinge and an outer edge of a portion in a vicinity of the portion of the second case located outward of the hinge as a hinge corresponding portion are continuous with an outer edge of another portion of the second case, and a hinge corresponding portion of the first case is provided with a retraction space which receives the hinge corresponding portion of the second case, wherein said supply reel mounting portion and said winding reel mounting portion are formed on a bottom surface of the first case, said bottom surface being parallel to said axis of rotation of said hinge, wherein the supply reel mounting portion rotatably engages with a supply reel of a refill, wherein the winding reel mounting portion rotatably supports a winding reel of the refill, wherein the supply reel mounting portion comprises:

a supply reel support portion which rotates together with the supply reel when the supply reel support portion is inserted into a meshing hole of the supply reel; and a drive gear which is coaxially mounted on the supply reel support portion, wherein the winding reel mounting portion is inserted into a winding reel mounting hole formed in a tip end of the winding reel, wherein a lid of the second case comprises a couple of insertion projections, said insertion projections being fitted into supported holes and formed in a support plate at two locations corresponding to centers of the supply reel and the winding reel, wherein, in said open position, an entire upper surface of the first case and an entire upper surface of the second case are exposed, wherein, in said use position, said upper surface of the second case extends outside said upper surface of the first case in a rear end of the transfer tool, and coincides with said upper surface of the first case in a front end of the transfer tool and wherein said retraction space is provided below the hinge as an indentation in an extension of a curvature of an upper surface of the second case through said outer edge of the second case such that the second case rotates around the hinge more than 180° in the open position.

* * * * *